US008034187B2

(12) United States Patent
Schmitt

(10) Patent No.: US 8,034,187 B2
(45) Date of Patent: Oct. 11, 2011

(54) SINK DRAIN ADAPTER FOR DRAIN CLEANING DEVICE

(75) Inventor: Randall Paul Schmitt, Clinton Township, MI (US)

(73) Assignee: Masco Corporation, Taylor, MI (US)

( * ) Notice: Subject to any disclaimer, the term of this patent is extended or adjusted under 35 U.S.C. 154(b) by 1766 days.

(21) Appl. No.: 10/872,940

(22) Filed: Jun. 21, 2004

(65) Prior Publication Data

US 2005/0279388 A1 Dec. 22, 2005

(51) Int. Cl.
*B08B 9/032* (2006.01)
*B08B 9/00* (2006.01)

(52) U.S. Cl. ..... 134/22.12; 134/22.1; 134/22.11; 134/22.18; 134/166 C; 134/167 C

(58) Field of Classification Search ..... 134/166 C, 134/167 C, 22.1, 22.11, 22.12, 22.18; 137/799, 137/843, 853; 285/8, 107, 109; 4/255.08
See application file for complete search history.

(56) References Cited

U.S. PATENT DOCUMENTS

| | | | | |
|---|---|---|---|---|
| 402,600 | A | | 5/1889 | Kemp |
| 1,747,933 | A | | 2/1930 | Goodman |
| 1,988,198 | A | | 1/1935 | German |
| 2,016,498 | A | | 10/1935 | Hopewell |
| 2,061,553 | A | | 11/1936 | Acosta |
| 2,583,694 | A | | 1/1952 | Fulton |
| 2,733,450 | A | * | 2/1956 | Wallace ..... 4/255.06 |
| 3,608,098 | A | | 9/1971 | Andrisani |
| 3,714,951 | A | * | 2/1973 | Lundman ..... 134/167 C |
| 3,787,905 | A | * | 1/1974 | Curzon ..... 4/255.08 |
| 3,792,708 | A | | 2/1974 | Tash |
| 3,808,611 | A | * | 5/1974 | Neuman ..... 4/255.01 |
| 4,238,860 | A | * | 12/1980 | Dixon ..... 4/255.08 |
| 4,460,019 | A | * | 7/1984 | Condon ..... 138/90 |
| 4,475,255 | A | * | 10/1984 | Tash ..... 4/255.08 |
| 4,606,364 | A | | 8/1986 | Tash |
| 4,865,062 | A | * | 9/1989 | Tash ..... 134/167 C |
| 4,895,178 | A | * | 1/1990 | McHugh ..... 134/167 C |
| 5,269,027 | A | | 12/1993 | Iatropoulos |
| 5,329,646 | A | * | 7/1994 | Bevacco et al. ..... 4/255.08 |
| 6,185,755 | B1 | | 2/2001 | Shepherd et al. |

* cited by examiner

*Primary Examiner* — Alexander Markoff
(74) *Attorney, Agent, or Firm* — Carlson, Gaskey & Olds, PC

(57) ABSTRACT

The present invention is a drain adapter for adapting a flushing device to a drainpipe. The adapter has a main body including an indent portion for retaining the flushing device during operation. The main body also includes an enlarged portion. The enlarged portion corresponds to a sink recess and expands under pressure to retain the adapter within the drainpipe.

19 Claims, 4 Drawing Sheets

SINK DRAIN ADAPTER FOR DRAIN CLEANING DEVICE

BACKGROUND OF THE INVENTION

The present invention relates to adapting a flushing device to a drainpipe.

Drainpipes in sinks occasionally become blocked and require cleaning. Flushing devices have been designed to remove debris from the drainpipe when traditional cleaning methods do not work. The flushing device is inserted into a drainpipe. The flushing device is also connected to a water source, such as a hose. Water is sent through the flushing device and a valve creates a pulsing action to the water, which removes the debris from the drain. This type of flushing device should be inserted into the drainpipe several inches in order to operate correctly. However, to deter debris from entering the drainpipe, cross-members are located just inside the drainpipe entrance. The cross-members restrict the insertion depth of the flushing device.

Adapters are used with the flushing devices to accommodate for the abbreviated insertion distance resulting from the crosshatches. For one style of adapter, a first end of the adapter is inserted into the sink drain while the other end receives the flushing device. The adapter increases the allowable insertion distance for the flushing device such that it is sufficient to allow proper operation.

During operation, water pressure builds between the blockage and the flushing device until the blockage is removed. For blockages that are difficult to remove, the increasing water pressure creates an upward force on the adapter pushing it from the pipe. Due to the short insertion distance of the adapter, it is difficult to retain the adapter in position. Additionally, when the flushing device and water source fill with fluid. The adapter becomes top heavy and may dislodge during operation. Thus, large amounts of physical exertion by the user are needed to retain the adapter in position. Also, because of the short sealing distance between the adapter and the pipe, the increasing water pressure may cause leaks to occur between the pipe and the adapter. Thus, an adapter which has enhanced sealing capability and that is easily retained in the drainpipe is needed.

SUMMARY OF THE INVENTION

The present invention provides an adapter for use between a flushing device and a drainpipe. The adapter has a main body. A first end of the main body has a first opening for receiving a flushing device. A second end of the main body has a second opening allowing fluid to exit the flushing device and the adapter, and enter a drainpipe.

An indent is included on the main body to correspond to recesses on the flushing device. During operation the flushing device expands within the adapter. The indent is received in one of the recesses and the expanding flushing device creates pressure against the adapter. Pressure between the flushing device walls and the indent retains the flushing device within the adapter.

The main body also includes an enlarged portion that is disposed between the indent and the second end. The enlarged portion is expandable under pressure. The size and location of the enlarged portion on the adapter corresponds to a recess in a sink bottom. The enlarged portion interacts with the sink recess to retain the adapter in an upright position during use. When water pressure builds in the pipe during operation, the enlarged portion will expand from the water pressure and contact the sink recess to retain the adapter in the drainpipe. If additional pressure is needed to retain the adapter in the drainpipe, the enlarged portion also provides a surface where downward pressure can be applied by the user. Thus, the adapter is retained within the drainpipe during operation with little or no exertion needed on the part of the user.

Concentric rings located on the second end of the adapter create an interference fit with the drainpipe to seal against any leaks. Any leaks that do occur are directed into a sink bottom by striations within the enlarged portion. Thus, back pressure is not created between the adapter and sink.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
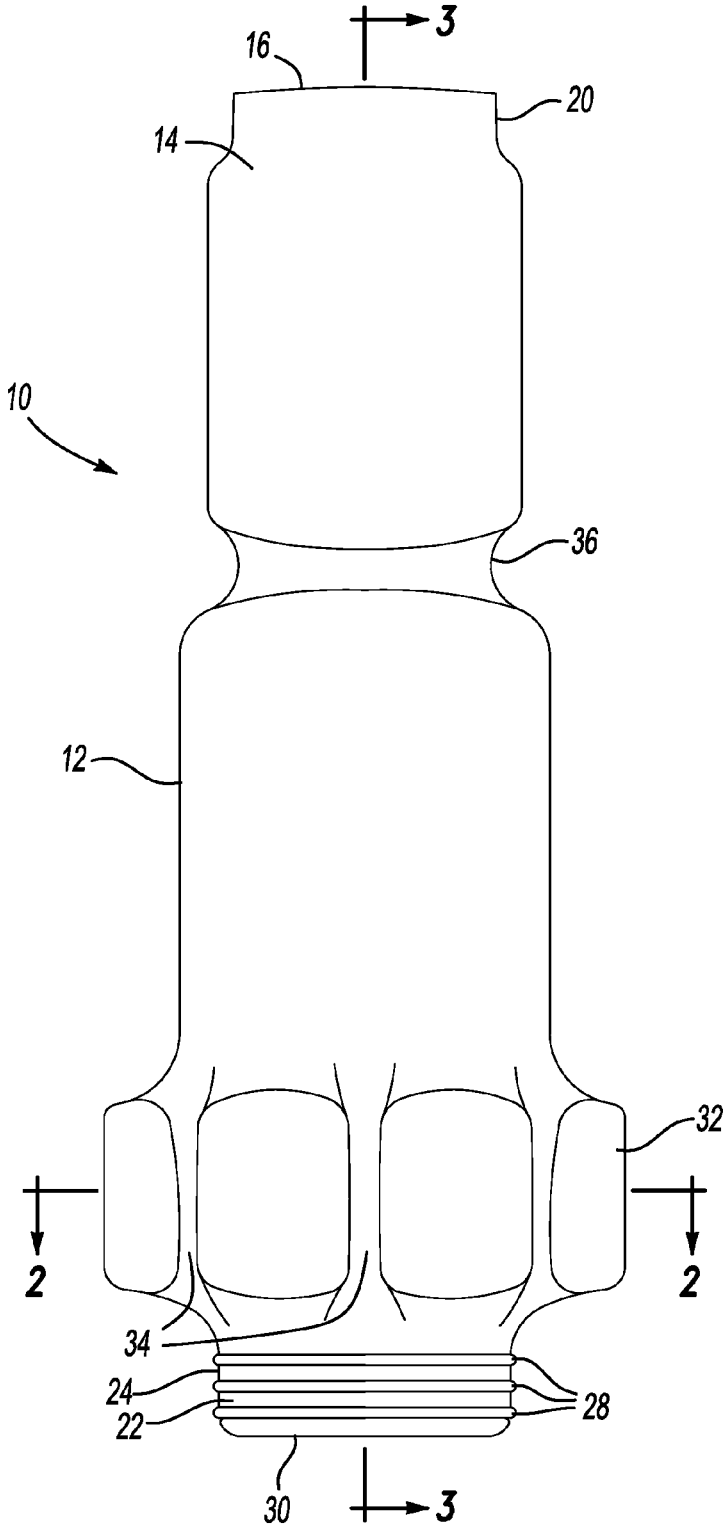
FIG. 1 is a general view of an embodiment of an adapter.

FIG. 1 illustrates a general view of an adapter 10. The adapter 10 has a main body 12. A first end 14 of the main body 12 has a first opening 16, for receiving a flushing device 18 (shown in FIG. 3). The first end 14 includes a neck portion 20 having a smaller diameter than the main body 12. The smaller diameter of the neck portion 20 assists in retaining the flushing device 18 in an upright position. However, the diameters of the first opening 16 and neck portion 20 are large enough to easily receive the flushing device 18. Indent 36 is located on the main body 12, between a second end 22 and the neck portion 20. The diameter of the indent 36 is smaller than the diameter of the main body 12.

The second end 22 is located at an opposing end of the main body 12 from the first end 14. The second end 22 has an insertion portion 24 to be inserted into a drainpipe 26 (shown in FIG. 3) during operation. The insertion portion 24 has a smaller diameter than the main body 12 to accommodate for the size of the drainpipe 26. Rings 28 run concentric about the insertion portion 24 and have a larger diameter than the insertion portion 24 and the drainpipe 26 to create a seal between the adapter 10 and the drainpipe 26. The second end 22 has a second opening 30 located at the bottom of insertion portion 24. The second opening 30 allows water from the flushing device 18 to pass through to the drainpipe 26 during operation.

An enlarged portion 32 is located on the main body 12 adjacent the insertion portion 24. The enlarged portion 32 has a larger diameter than the main body 12. The size and position of the enlarged portion 32 correspond to a sink recess 44 (shown in FIG. 3) when the adapter is in use. Striations 34 are included on the enlarged portion 32 and run from the insertion portion 24 all the way to the main body 12. The striations 34 follow the same curvature as the enlarged portion 32 along the length of the adapter 10.

Figure 2:
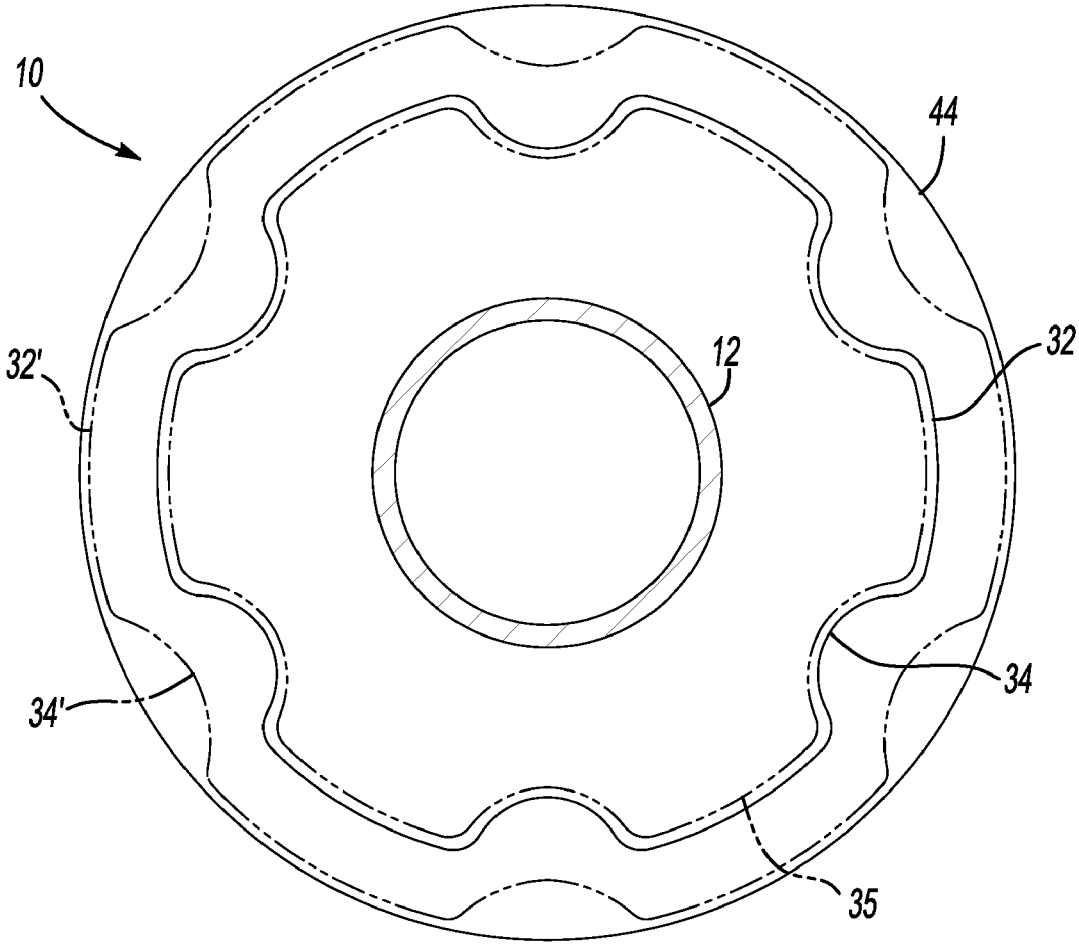
FIG. 2 is a cross-section along line 2-2 from FIG. 1, of an embodiment of the adapter showing an enlarged portion having striations.

FIG. 2 shows a cross-section of the adapter 10, along line 2-2 of FIG. 1, through the enlarged portion 32. The striations 34 have a smaller diameter than the enlarged portion 32. Thus, when the enlarged portion 32, comes into contact with a sink recess 44 the striations 34 provide a vent allowing water to pass through. As shown in one embodiment the striations 34 have an arcuate cross-section. Although the main body 12 of the adapter 10 is generally rigid the enlarged portion 32 may expand under pressure. Even though the striations 34 are made from a generally rigid material, such as plastic, the striations 34 assist the enlarged portion 32 in expanding. The main body 12 does not have striations, and thus is not expandable. The change in cross-section of the enlarged portion 32' when under pressure is shown in phantom. Alternatively, the enlarged portion 32 may have a thinner wall 35 then the main body 12, thus making the material less rigid, and expandable.

Figure 3:
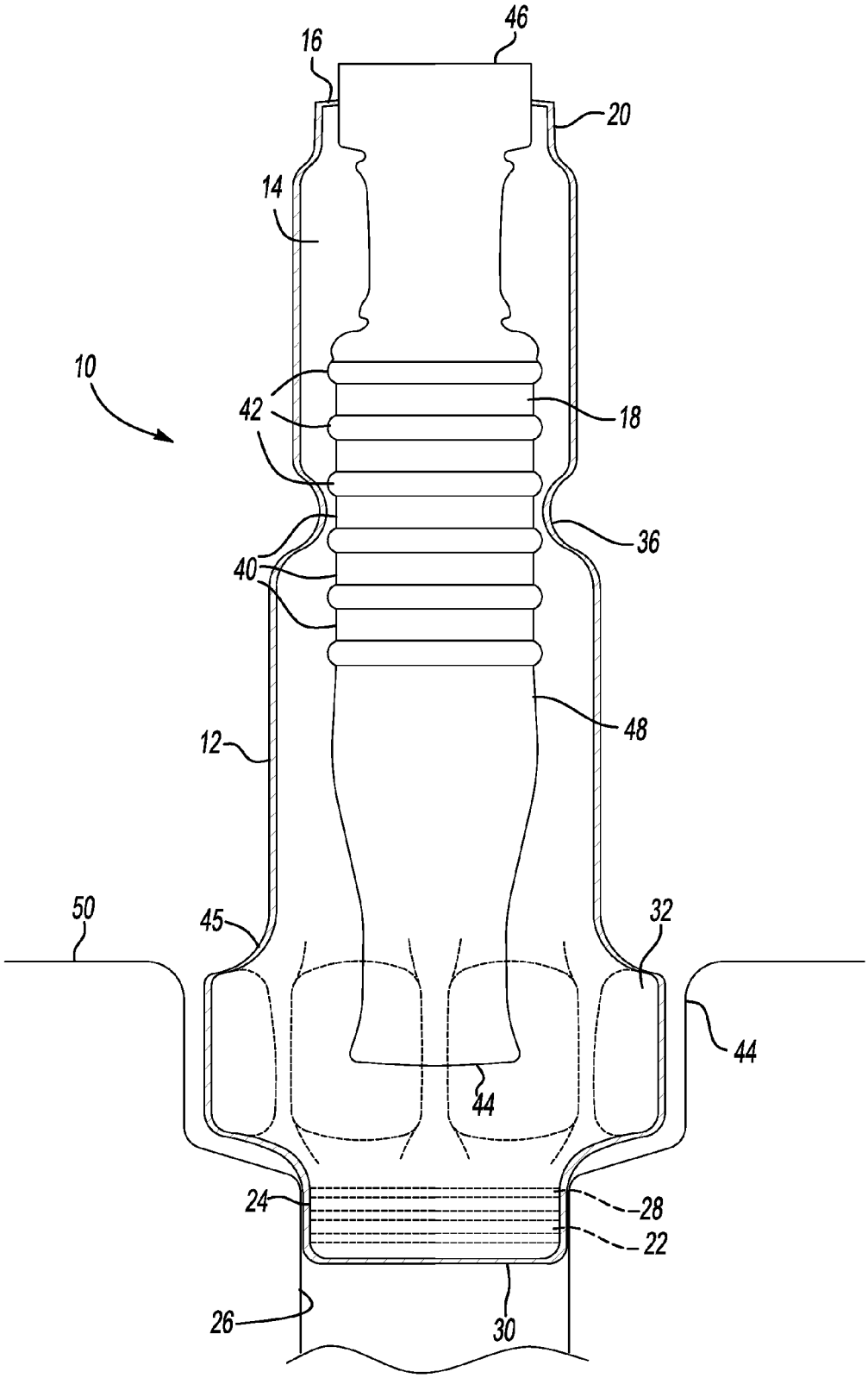
FIG. 3 is a cross section along line 3-3 from FIG. 1 of an adapter with a flushing device and pipe illustrated in the proper locations.

Referring to FIG. 3 a cross-section of the adapter 10 is shown. The adapter 10 is inserted into the drainpipe 26 and the flushing device 18 is received through the first opening 16. As shown, the first opening 16 and neck portion 20 are larger in diameter than the flushing device 18. The flushing device 18 is inserted to a distance where an exit end 38 of the flushing device 18 has entered the enlarged portion 32, but not far enough to enter the insertion portion 24. A minimum distance between the exit end 38 and the second opening 30 must be maintained to allow for elongation of the flushing device 18 during operation. The flushing device 18 includes a series of recesses 40 for alignment with the indent 36 on the adapter 10. Protrusions 42 between the recesses 40 provide feedback as the user is inserting the flushing device 18 into the adapter 10, allowing the user to determine when the flushing device 18 has been inserted the proper distance into the adapter 10.

The second end 22 of the adapter 10 is inserted into a drainpipe 26. The rings 28 form an interference fit with the drainpipe 26. When the adapter 10 is inserted into the drainpipe 26 the enlarged portion 32 easily fits within a sink recess 44. During operation the enlarged portion 32 interacts with the sink recess 44 to hold the adapter 10 in an upright position, compensating for the weight of the flushing device 18, and the water source.

Figure 4:
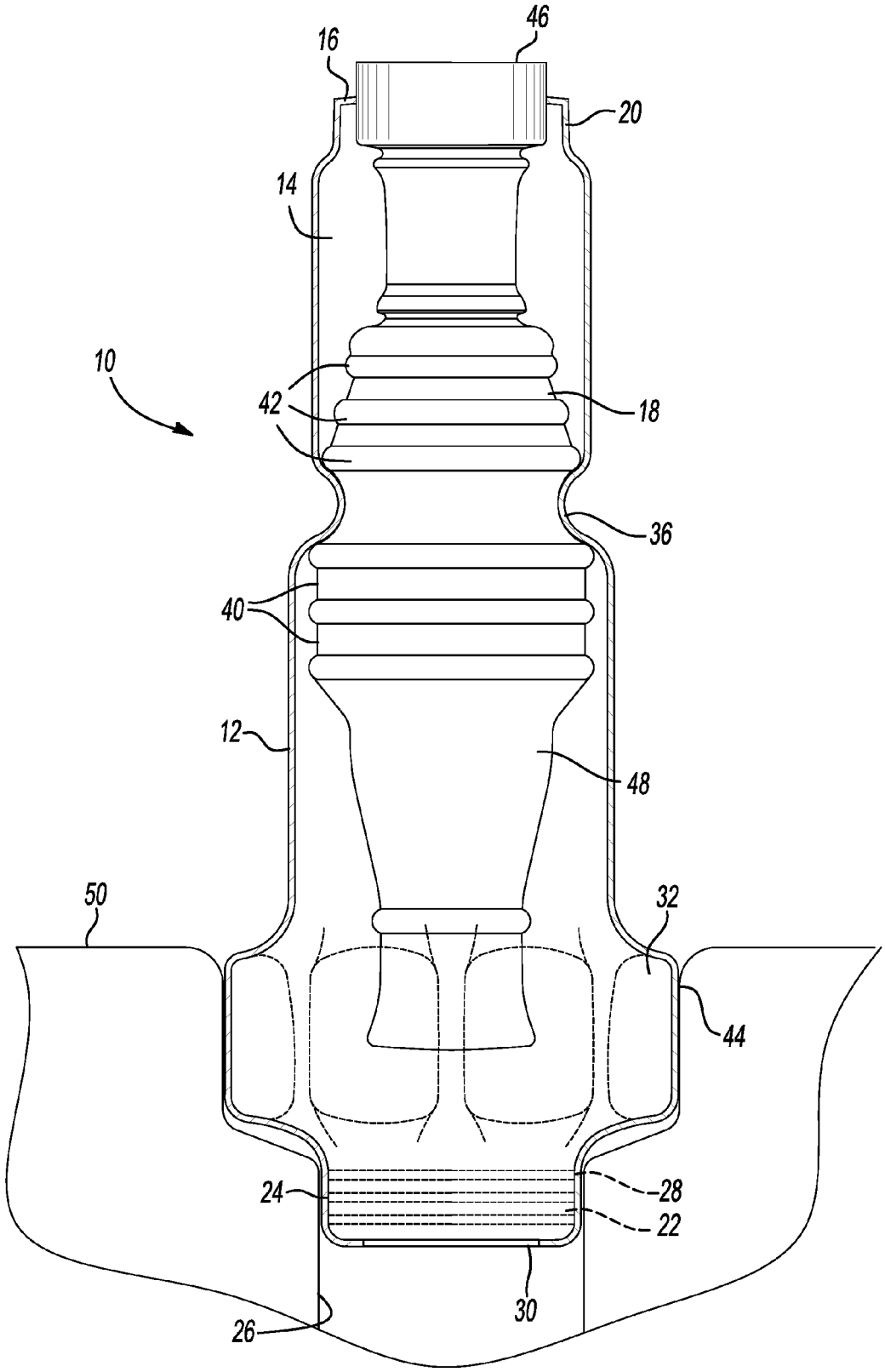
FIG. 4 is a cross-section of an adapter along line 3-3 from FIG. 1 showing the arrangement of the adapter and flushing device during use.

FIG. 4 shows the adapter 10 when the flushing device 18 is being operated. The flushing device 18 is connected to the water source at an entrance end 46. An internal valve (not shown) allows water pressure to build within the flushing device. As pressure builds the walls 48 of the flushing device 18 expand. The main body 12 of the adapter 10 is rigid. Thus, as the flushing device 18 expands it is locked into place by the indent 36, which corresponds to one of the recesses 40. Once the water pressure has reached a sufficient level the valve in the flushing device 18 opens and releases the water. The water flows through the second opening 30 into the drainpipe 26. The building and releasing of water pressure creates a pulsing action that can be repeated until the blockage is removed.

Occasionally pulsing of the water is not enough to clear the blockage and water will begin to back up in the drainpipe 26. The water will back up until it enters the adapter 10, through the second opening 30. As water is continuously pulsed out of the flushing device 18 the pressure of water in the drainpipe 26 and the adapter 10 increases. When this occurs the striations 34 allow the enlarged portion 32 to expand as a result of the pressure. The enlarged portion 32 will then contact sink recess 44. The contact pressure between the enlarged portion 32 and the sink recess 44 is proportional to the water pressure in the adapter 10. Thus, as the pressure in the adapter 10 increases the contact pressure between the enlarged portion 32 and the sink recess 44 will help to retain the adapter 10 in the drainpipe 26. If additional pressure is needed to retain the adapter in place the enlarged portion 32 provides a surface 45 on which downward pressure may easily be applied, reducing the efforts of the user.

If the increase of water pressure becomes great enough to cause leaks between the drainpipe 26 and the rings 28 then water may enter the sink recess 44. The striations 34 in the enlarged portion 32 allow this water to pass through to the sink bottom 50. Allowing any water leakage to pass through will prevent pressure from building between the enlarged portion 32 and the sink recess 44 that would force the adapter out of the drainpipe 26.

Eventually the water pressure will reach a high enough level to force the drainpipe clear. At this point the water pressure in the adapter 10, and flushing device 18 decreases. The water source may be shut off and the adapter 10 and flushing device 18 may be easily disassembled.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A drain cleaning adapter comprising:

a main body;

a first end of said main body having a first opening for receiving a flushing device;

a second end opposing said first end, said second end having a second opening for allowing discharge of a fluid; and an enlarged portion between said first end and said second end wherein said enlarged portion is expandable between an initial position and an expanded position that is radially outward of said initial position, and wherein said enlarged portion is expandable in response to an increase in fluid pressure within the drain cleaning adapter, said enlarged portion being expandable between an initial non-contact position with a sink recess and an expanded contact position with the sink recess.

2. The drain cleaning adapter of claim 1, wherein said enlarged portion has at least one striation extending in an axial direction from said enlarged portion toward said first end.

3. A drain cleaning adapter comprising:

a main body;

a first end of said main body having a first opening for receiving a flushing device;

a second end opposing said first end, said second end having a second opening for allowing discharge of a fluid, and wherein said main body includes an insertion portion at said second end, said insertion portion including a plurality of annular sealing rings; and an enlarged portion between said first end and said second end wherein said enlarged portion is expandable between an initial position and an expanded position that is radially outward of said initial position, and wherein said enlarged portion has at least one striation extending in an axial direction from said enlarged portion toward said first end, and wherein said enlarged portion is positioned between said insertion portion and said main body, with said at least one striation extending from said main body to said insertion portion.

4. A drain cleaning adapter comprising:

a main body;

a first end of said main body having a first opening for receiving a flushing device;

a second end opposing said first end, said second end having a second opening for allowing discharge of a fluid; and an enlarged portion between said first end and said second end wherein said enlarged portion is expandable between an initial position and an expanded position that is radially outward of said initial position, and wherein said main body has at least one indent concentric about said main body, and which is between said enlarged portion and said first end.

5. The drain cleaning adapter of claim 4, wherein said at least one indent has a smaller diameter than said main body.

6. The drain cleaning adapter of claim 5, wherein said at least one indent corresponds to recesses on said flushing device.

7. A drain cleaning adapter comprising:

a main body;

a first end of said main body having a first opening for receiving a flushing device;

a second end opposing said first end, said second end having a second opening for allowing discharge of a fluid; and an enlarged portion between said first end and said second end wherein said main body has a greater rigidity than said enlarged portion, and wherein said enlarged portion is expandable between an initial position and an expanded position that is radially outward of said initial position.

8. A method of using a drain cleaning adapter having a main body with a first end, a second end, and an enlarged portion positioned between the first and second ends, the method comprising:

a) inserting a flushing device into the first end of the main body;

b) inserting the second end of the main body into a drainpipe; and c) expanding the enlarged portion of the main body in response to an increase in water pressure from an initial position to an expanded position such that the enlarged portion contacts walls defining a sink recess.

9. A drain cleaning adapter comprising:

a main body having a first end with a first opening for receiving a flushing device;

a second end opposing said first end, said second end having an insertion portion for inserting into a drainpipe and a second opening for allowing discharge of a fluid;

an indent on said main body disposed between said first end and said second end; and an enlarged portion between said first end and said second end wherein said main body has a first rigidity and said enlarged portion has a second rigidity that is less than said first rigidity, and wherein said enlarged portion is expandable in response to an increase in fluid pressure within the drain cleaning adapter between an initial position and an expanded position that is radially outward of said initial position.

10. The drain cleaning adapter of claim 9, wherein said enlarged portion has at least one striation that extends in an axial direction from said insertion portion toward said first end.

11. The drain cleaning adapter of claim 10, wherein said at least one striation is defined by an arcuate surface.

12. A drain cleaning adapter comprising:

a main body having a first end with a first opening for receiving a flushing device;

a second end opposing said first end, said second end having an insertion portion for inserting into a drainpipe and a second opening for allowing discharge of a fluid;

an indent on said main body disposed between said first end and said second end; and an enlarged portion between said first end and said second end wherein said enlarged portion is expandable in response to an increase in fluid pressure within the drain cleaning adapter between an initial position and an expanded position that is radially outward of said initial position; and wherein said enlarged portion has at least one striation that extends in an axial direction from said insertion portion toward said first end, and wherein said at least one striation comprises a plurality of striations spaced apart from each other about an outer periphery of said enlarged portion, and wherein each of said striations is defined by a surface that does not contact a sink recess wall when said enlarged portion is in said expanded position such that a plurality of vents are created to allow water to pass from the drainpipe into a sink bottom.

13. The drain cleaning adapter of claim 9 wherein said flushing device includes an exit end that is to be aligned with said enlarged portion.

14. The method of claim 8 including aligning an exit end of the flushing device with the enlarged portion such that the exit end is surrounded by the enlarged portion.

15. The method of claim 8 including forming at least one vent to allow water to flow from the drainpipe into a sink along an outer surface of the enlarged portion.

16. The method of claim 15 including forming the at least one vent by forming at least one striation on the outer surface of the enlarged portion, the at least one striation having a surface that does not contact the walls of the sink recess when the enlarged portion is in the expanded position.

17. The method of claim 8 including forming the main body to have a first rigidity and the enlarged portion to have a second rigidity that is less than the first rigidity.

18. The drain cleaning adapter of claim 1, wherein said flushing device is expandable within said drain cleaning adapter from a first position to a second position that is radially outward of said first position, and wherein said flushing device includes a first end to be connected to a water supply and an exit end that is spaced radially inward from, and surrounded by, an inner wall of said enlarged portion.

19. A drain cleaning adapter comprising:

a main body;

a first end of said main body having a first opening for receiving a flushing device;

a second end opposing said first end, said second end having a second opening for allowing discharge of a fluid; and an enlarged portion between said first end and said second end wherein said enlarged portion is expandable between an initial position and an expanded position that is radially outward of said initial position, and wherein said enlarged portion includes a plurality of striations formed about an outer periphery of said enlarged portion, each of said striations having a surface that is spaced apart from a sink recess wall to form a plurality of vents that direct water from the drainpipe into a sink.

* * * * *